US009032646B2

(12) United States Patent
Perenich

(10) Patent No.: US 9,032,646 B2
(45) Date of Patent: May 19, 2015

(54) ENERGY-RETURN SHOE SYSTEM

(71) Applicant: Stephen Perenich, Bettendorf, IA (US)

(72) Inventor: Stephen Perenich, Bettendorf, IA (US)

( * ) Notice: Subject to any disclaimer, the term of this patent is extended or adjusted under 35 U.S.C. 154(b) by 259 days.

(21) Appl. No.: 13/682,868

(22) Filed: Nov. 21, 2012

(65) Prior Publication Data

US 2013/0125422 A1 May 23, 2013

Related U.S. Application Data

(60) Provisional application No. 61/563,308, filed on Nov. 23, 2011.

(51) Int. Cl.
*A43B 13/18* (2006.01)
*A43B 1/00* (2006.01)

(52) U.S. Cl.
CPC ..... *A43B 13/181* (2013.01); *A43B 13/186* (2013.01); *A43B 1/0054* (2013.01); *A43B 13/182* (2013.01); *A43B 13/184* (2013.01)

(58) Field of Classification Search
CPC .... A43B 13/18; A43B 13/182; A43B 13/183; A43B 13/185; A43B 13/186
USPC ..... 36/7.8, 27, 28, 114, 132
See application file for complete search history.

(56) References Cited

U.S. PATENT DOCUMENTS

| | | | | |
|---|---|---|---|---|
| 1,613,538 | A | | 1/1927 | Schad |
| 1,964,406 | A | | 6/1934 | Pellkofer |
| 2,408,617 | A | | 10/1946 | Ferrar |
| 2,522,515 | A | | 9/1950 | Hill |
| 2,953,861 | A | | 9/1960 | Horten |
| 3,205,596 | A | | 9/1965 | Hoffmeister |
| 3,219,358 | A | | 11/1965 | Hagner |
| 3,557,782 | A | | 1/1971 | Wafer |
| 4,196,903 | A | | 4/1980 | Illustrato |
| 4,296,557 | A | | 10/1981 | Pajevic |
| 4,302,891 | A | | 12/1981 | Gulli |
| 4,457,084 | A | | 7/1984 | Horibata et al. |
| 4,492,374 | A | | 1/1985 | Lekhtman et al. |
| 4,912,859 | A | | 4/1990 | Ritts |
| 4,936,030 | A | | 6/1990 | Rennex |
| 4,944,099 | A | | 7/1990 | Davis |
| 5,282,325 | A | | 9/1995 | Ikeda |
| 5,464,380 | A | * | 11/1995 | Ikeda et al. ..... 601/29 |
| 5,621,984 | A | | 4/1997 | Hsieh |
| 5,701,685 | A | | 12/1997 | Pezza |
| 5,896,679 | A | | 4/1999 | Baldwin |
| 5,916,071 | A | | 6/1999 | Lee |
| 5,926,975 | A | | 7/1999 | Goodman |
| 6,115,942 | A | | 9/2000 | Paradis |
| 6,115,943 | A | * | 9/2000 | Gyr ..... 36/35 R |
| 6,189,239 | B1 | | 2/2001 | Gasparovic et al. |

(Continued)

*Primary Examiner* — Marie Bays
(74) *Attorney, Agent, or Firm* — Larsen & Larsen, P.A; Frank Liebenow; Patrick Reid

(57) ABSTRACT

An energy return shoe system has a shoe portion, a flexible lower sole portion and a toe mechanism. The toe mechanism has an upper toe plate, a lower toe plate, and at least two toe arms. The upper toe plate is affixed to the shoe portion, the lower toe plate is affixed to the lower sole, and the toe arms are pivotally affixed at ends to the upper toe plate and the lower toe plate and are substantially parallel to each other. The lower sole is made of a flexible material and there is at least one spring mechanism that urges the shoe portion away from the lower sole. As the wearer steps down, energy of the wearer's mass is stored in one or more spring devices and as the wearer begins to lift their foot, the stored energy is returned to help push that foot off the ground.

20 Claims, 6 Drawing Sheets

(56) References Cited

U.S. PATENT DOCUMENTS

| | | | | |
|---|---|---|---|---|
| 6,684,531 | B2 | 2/2004 | Rennex | |
| 6,901,686 | B2 | 6/2005 | Hayes | |
| 6,928,756 | B1 * | 8/2005 | Haynes | 36/27 |
| 7,290,354 | B2 | 11/2007 | Perenich | |
| 7,448,148 | B2 | 11/2008 | Martinez et al. | |
| 7,900,377 | B1 | 3/2011 | Perenich | |
| 7,905,033 | B1 | 3/2011 | Perenich | |
| 7,913,422 | B1 | 3/2011 | Perenich | |
| 7,950,166 | B1 | 5/2011 | Perenich | |
| 8,171,657 | B1 | 5/2012 | Perenich | |
| 8,627,582 | B2 * | 1/2014 | Perenich | 36/27 |
| 8,627,583 | B2 * | 1/2014 | Perenich | 36/27 |
| 2004/0040180 | A1 | 3/2004 | Rennex et al. | |
| 2005/0262725 | A1 | 12/2005 | Rennex et al. | |
| 2010/0281710 | A1 * | 11/2010 | Killion | 36/27 |
| 2011/0119953 | A1 | 5/2011 | Perenich | |
| 2011/0162231 | A1 | 7/2011 | Perenich | |
| 2013/0145649 | A1 * | 6/2013 | Killion | 36/27 |

* cited by examiner

ENERGY-RETURN SHOE SYSTEM

TECHNICAL FIELD OF THE INVENTION

The present invention relates to the general art of footwear, and to the particular field of impact absorbing and energy-return mechanisms associated with footwear.

BACKGROUND OF THE INVENTION

It has long been known, that when people walk, jog, or run, a significant percentage of their forward and upward kinetic energy is wasted and lost. This loss results in two undesirable effects, the first of which is locomotion inefficiency. More specifically, a person's potential for attaining their maximum walking/running speed and endurance as well as jumping height (without motorized assistance) is diminished. The second negative effect of this lost energy is manifested in the substantial shock which is imparted to a person's knees and feet when impacting with the ground while running or jumping. As a result, great effort has been exerted by both independent inventors and large corporations to develop effective "energy-return" footwear that could replace standard athletic footwear.

Energy-return footwear designs, generically referred to as "spring-shoes", have been around for centuries and may be as old as the invention of springs themselves. The concept is obvious: build shoes with springs or some other energy storage device and augment a person's performance and/or comfort. However, this has been a difficult task as evidenced by the hundreds of such patents, filed since the mid 1800s, with very few designs being accepted in the marketplace.

Designing an effective energy-return shoe requires identifying and meeting several important objectives. The shoe must: 1) store and return a significant portion of kinetic energy, 2) be stable and controllable, 3) promote a natural motion during locomotion, 4) be both durable and reasonably light, 5) be simple in design, and 6) be designed with spring geometry that can be optimized for either comfort or performance or any compromise in between. Creating a shoe that successfully combines these qualities would represent a revolutionary advancement in the art and insure its widespread acceptance by consumers.

In order to store and return a significant portion of energy during locomotion (i.e. the first objective), a shoe's sole must transfer kinetic energy due to heel compression forces, and return them to the toe, during liftoff. That is, the heel and toe portions of the soles must work together upon heel-strike and toe-lift, allowing greater energy storage and return. Additionally, the sole must be both substantially compressible and free to compress and expand without hindrance (i.e. not be dampened by the walls of a rubber sole or any other impediments). Furthermore, the spring rates should be tailored to the user's weight and specific use such that the springs store and return as much of the impact forces as possible. These qualities work together to insure that during toe-off the wearer will experience the right force at the right time for a reasonable duration. Energy-return can be even further augmented if a shoe's sole can be held in the compressed position through the point of peak load and released during toe lift-off. Such an arrangement would allow for spring rates 2 to 3 times higher than would otherwise be used.

An effective energy-return footwear design needs to be both stable and controllable. This aspect is important both for allowing a user to effectively use the energy that is returned and for obvious safety reasons. Shoes with compressible soles that have been designed with an emphasis on energy-return have struggled in meeting this objective. This is often due to the fact that the lower sole is not constrained in its movement relative to the upper sole and there is no provision for the use of a wearer's toes (or a structure that performs in a similar function) or in the case of higher compression designs there is a lack of ankle support. More specifically, the lower sole may slide or skew longitudinally or laterally, or sometimes in any direction, relative to the wearer's foot and the design may employ a rigid upper and lower sole that does not bend at the ball of the foot limiting the user's balance and traction that toes can provide. In many cases, where sole designs have sought to address these limitations, they have relied on the use polymers instead of, or in addition to, mechanical devices or they have limited the use of mechanical devices to the heel region. In so doing, these designs have compromised energy-return.

The sole design of an effective energy-return shoe promotes a natural motion during locomotion. This is important because energy-return footwear that encourages unnatural motions by the wearer compromises the benefits of storing and returning energy in locomotion and may also pose a safety risk. To provide for natural movement, the shoe sole design must: provide for the effective use of the wearer's toes (i.e., upper and lower toe sole pivoting from an upper and lower heel sole), release the stored-energy in a direction that is perpendicular to the user's foot (i.e. generally in line with the wearer's leg), provide a rigid lower sole frame with a flexible tread surround that is likened to a bare foot (or in the case of a higher-compression design, a laterally tilting lower sole with longitudinally pivoting heel and toe pads) and release the stored energy at an optimal time during the stride. Other energy-return footwear designs that have inadequately addressed these requirements have failed to promote a natural running motion and would not be considered a viable alternative to standard athletic footwear.

An effective energy-return footwear design needs to be both durable and reasonably light. This goal represents a significant challenge for full-length mechanical soles due to the extreme forces at play and fact that they usually rely on metal components that are either reasonably light or durable but not both. Although major advancements have been made in the area of materials engineering (i.e. composite fibers) these developments alone cannot solve this problem. The solution, instead, is found in designing an efficient mechanical system that employs structure-leverage and the efficient use of materials. For example it is preferred that a large percentage of the sole's height or thickness be compressible (i.e. that it is not unnecessarily tall.)

The fifth characteristic of an effective energy-return shoe is that it be manufacturable. This is as important for energy-return footwear designs as it is for most any mechanical design. Benefits to design simplicity include reduced friction, improved durability and minimized manufacturing cost.

A design for an effective energy-return shoe should be such that the spring geometry can be optimized for either comfort or performance or any compromise in between. There exist many energy-return footwear patents that recognize the benefit of tailoring the energy-storage component's capacity to a user's weight and/or type of activity, but the vast majority of these designs do not address the merits of managing the force rates by which energy is stored and returned. The underlying premise of this concept is that there is a tradeoff between energy-absorption and energy-return. That is, a shoe that is designed for comfort would not be ideally suited for performance applications and vice-versa. More specifically, the energy-return forces for a comfort-designed shoe should be linear and progressive (for example as delivered by a simple compression spring as widely exemplified in the prior art). On the other hand, energy-return forces for a performance shoe should be either constant or regressive. For example, employing a regressive force rate would mean that as the shoe compresses, the resistance force diminishes and conversely, as the shoe expands, the expansion force increases. Additionally, the force curve could be developed as a wide range of compromises between pure comfort and pure performance. Such variety of force rate characteristics are achieved by using compression springs, torsion springs or extension springs between two opposing hinges or a spring combination thereof. The method and structure for creating force rate curves optimized for a variety of applications and preferences will be explained in the Detailed Description of the Invention section.

The following examples are provided to illustrate the limitations of these prior designs.

A patent of interest is U.S. Pat. No. 4,133,086 "Pneumatic Springing Shoe" to Brennan has a rigid lower sole supporting an upper sole via two pneumatic springs. This design is limited by lack heel-to-toe energy transfer and an inflexible lower sole which prevents a natural running motion. Also this design is unnecessarily heavy and bulky due to the fact that it requires a tall sole to produce the desired amount of compression.

U.S. Pat. No. 4,196,903 "Jog-Springs" to Illustrato employs a full-length spring-suspended sole but does not provide a correlation between the heel springs and the toe springs to effectively transfer energy from heel to toe. Additionally, it is limited by its inherent instability and uncontrollability and unnatural use.

U.S. Pat. No. 4,912,859 "Spring-shoe" to Ritts has a full-length mechanical sole that relies on a hefty longitudinal link to resist lateral tilting. This design is limited by a lack of heel-to-toe energy transfer and inflexible lower sole which prevents a natural running motion. Also this design relies on the stoutness of this link to limit such movement and thus adds considerable weight to the sole.

Another patent of interest is U.S. Pat. No. 4,936,030 to Rennex titled, "Energy Efficient Running Shoe." This patent recognizes that an increase in performance requires transfer of energy from heel-strike to the ball or toe region during step-off via a series of complex levers and shafts. This patent recognizes that an increase in performance may be possible with a system to hold the energy loaded during heel-strike and release it from the ball or toe region during step-off. This design employs a ratchet to hold the loaded spring and triggers its release by bending the toe section of the shoe. These structures provide neither an optimum nor precise timing for energy release. The optimum timing of energy release is immediately following ball peak-force during step-off. The system releases the loaded spring either: 1) when said spring reaches a certain and fixed degree of compression, 2) when said spring reaches the limit of compression during push-off, or 3) after a fixed time delay. Although the patent neither explains nor diagrams the process by which it accomplishes (2) or (3), these methods are inadequate and not optimal. The first and third processes are based on fixed criteria and cannot adapt to the variable forces and time periods during normal running. The second process is inadequate because it releases the spring prematurely. A user, during a turn or stop may load the forces on his forefoot at constant level before he has picked his final direction. This process therefore, can cause the user to lose control. The system does not guarantee nor does it disclose that the ball and heel will compress in a parallel manner. Additionally, these complex structures fall short in the area of promoting natural movement; provide a platform for stability, durability and lightness.

U.S. Pat. No. 5,343,637 "Shoe and Elastic Sole Insert Therefore" to Schindler has two elastic inserts contained within a hollow and flexible rubber sole. Although this design does allow flexibility at the ball of the foot, the lack of a framework for the lower sole results in an uncontrolled compression and expansion of the spring. This limits the user's ability to balance and move in a controlled fashion. To the extent that stiffer sole walls are used to improve stability, there is a commensurate increase in damping which diminishes the energy-return capacity of the spring.

Another patent of interest is U.S. Pat. No. 5,343,639 "Shoe with an Improved Midsole" to Kilgore et al., employs a "plurality of compliant elastomeric support elements" in the heel to absorb impact forces. Although this design attempts to make advances in the resilient material employed, it is still limited in the same way that all polymer-based designs are limited. More specifically, this design is compromised by the fact that there is no provision for the transfer of heel impact forces to the toe during lift-off, the sole is not substantially compressible and there is no provision for optimizing the energy-return force curves for performance applications.

In another patent of interest, U.S. Pat. No. 5,435,079 "Spring Athletic Shoe" to Gallegos has a conical heel spring. This design is limited by the lack of energy transfer from the heel to the toe. Additionally this design is limited in that the spring geometry cannot be tailored to anything other than comfort (i.e. not for performance applications).

U.S. Pat. No. 5,517,769, "Spring-Loaded Snap-Type Shoe," to Zhao. This patent recognizes that a significant increase in performance may be possible with a system to hold the energy loaded during heel-strike and release the energy during step-off. The system has a ratchet to hold the loaded spring and triggers its release by bending the toe section of the shoe. Thus, this system attempts to time the release of energy during step-off. This system provides neither an optimum nor precise timing for energy release. The optimum timing of energy release occurs immediately following the decrease force during step-off. The system releases the loaded spring when the user bends at the ball of the foot which is not necessarily during and perhaps never at the optimum time. The system also returns energy to the heel alone. This is not ideal because the heel is not in contact with the ground during step-off. The system also requires a hollow cavity extending the length of the foot for the containment of the ratchet and spring system but does not provide a suspension system for maintaining this cavity leaving it to compress randomly.

Another patent of interest is U.S. Pat. No. 6,029,374 to Herr: "Shoe and Foot Prosthesis with Bending Beam Spring Structures." This patent attempts to address the problem with carbon fiber bending beam springs. This patent also attempts to address the need for both heel and toe springs that prevent lateral movement. This structure is inadequate for some of the following reasons: 1) It does not provide a strictly parallel postured upper and lower sole and thus it cannot return more than half the user's weight, 2) it does not provide a parallel upper and lower toe sole and therefore depends on a tapered leaf spring for traction and control in which it does not provide either in an optimum way, 3) it does not provide a hold and release system (HRS) that limits the combined load forces of the springs to approximately the user's weight.

Another patent of interest is U.S. Pat. No. 6,282,814 B1 "Spring Cushioned Shoe" to Krafsur, et al., wherein wave springs are placed in the heel and toe regions of a polymer sole. Although this sole design does include mechanical components (i.e. wave springs) in both the toe and heel regions of the sole, their effectiveness is greatly diminished by their independence and disconnection which prevents a transfer of energy from the heel to the toe. Also, they are limited by the dampening effect of the polymer sole in which they are placed. Additionally, wave springs themselves tend to lack free movement due to the friction generated by their "crest to crest" design.

Another patent of interest is U.S. Pat. No. 6,684,531 to Rennex for a "Spring Space Shoe," which is hereby incorporated by reference. This patent introduces a spring-lever mechanism that provides some level of energy absorption upon impact and energy-return during step-off and has a series of linkages that prevent longitudinal tilting between the top and bottom soles. This design, however, is limited in its stability and controllability because it lacks a means to prevent front-to-back sliding of the user's foot with respect to the lower sole of the shoe. For example, in the mechanism of FIG. 1*a*, there is nothing to prevent the right side (heel of foot) of the mechanism from moving forward with respect to the left side (ball of foot). Additionally, the structures disclosed are not designed to prevent any substantial lateral forces from causing the upper sole to slide sideways relative to the lower sole. Another limitation in this design is that it does not include a toe sole structure, thereby eliminating the balance and control and traction that toes provide to a person. Furthermore, the disclosed "heel hugger" structure does not provide for an energy-return vector, perpendicular to the user's foot. This means that the energy is not released in a direction that is in-line with the force of the user's leg. Additionally it does not either provide a flexible tread/sole around the perimeter of the lower sole nor does it disclose a longitudinally non-tilting yet laterally pivoting lower sole with longitudinally pivoting heel and toe pads, so a user's lateral movement is constrained and becomes awkward. Finally, although it does suggest that a combination of different springs may be used to manage spring forces, it does not disclose how a torsion spring could be included for this purpose and how it could be used to effectively include it in the structure.

Another patent of interest is U.S. Pat. No. 6,719,671 B1 "Device for Helping a Person to Walk" to Bock. This patent has a large leaf spring that extends from the back of the knee to the shoe sole as a means of storing and releasing energy during locomotion. Although this design affords a large degree of sole compression, it also weighs more than 5 times the amount of other energy-return footwear. This is due, in large part, to the design and therefore size of the leaf spring. Additionally, this patent does not provide a strictly parallel postured upper and lower sole of normal length nor does it provide a parallel upper and lower toe sole and therefore does not provide adequate balance and control. Furthermore, it does not provide a longitudinally pivoting lower sole and therefore does not allow for adequate traction agility and control.

Finally, U.S. Patent Application 2004/0177531 titled, "Intelligent Footwear System," has a spring heel that adjusts tension in response to impact forces to modify performance characteristics. Although, this design accounts for the stiffness requirement of a spring depending on the activity it is limited in a number of respects. First there is no transfer of energy from the heel to the toe. Additionally the spring geometry can not be altered and so the shoe is only optimized for comfort and would not be very effective in performance applications. Also, like other shoes that have a polymer component, this design is compromised in its ability to freely store and return energy.

Spring-shoes thus have not been entirely satisfactory in that they have not permitted users to concurrently experience substantial energy-return, traction, control, safety and agility, and therefore have been viewed as incomparable and inferior to non-spring-loaded footwear. Furthermore, we are no closer to reaching the dream of augmenting performance, as no non-fuel-propelled footwear device has so far allowed users to increase their maximum running speed. (While some have allowed an increase in stride-length, their unnatural use and/or excessive weight prevent users from running any faster than with standard running shoes.) Additionally, these prior efforts have employed either complex, expensive, unreliable structures and/-or ineffective and imprecise structures. What is needed is a shoe system that achieves the aforementioned six objectives.

SUMMARY OF THE INVENTION

A simplified energy return shoe has a shoe portion, a flexible lower sole portion and an energy-release toe mechanism. As the wearer steps down, energy of the wearer's weight is stored in one or more spring devices and as the wearer begins to lift the foot, the stored energy is returned to help push that foot off the ground.

In one embodiment, an energy-return shoe system is described including a shoe portion having a bottom surface and a toe mechanism. The toe mechanism includes an upper toe plate, a lower toe plate and several toe arms. The upper toe plate is affixed to the bottom surface of the toe area of the shoe portion and the lower toe plate affixed to a top surface of the toe area of a lower sole. A first end of each toe arm is pivotally affixed to the upper toe plate and a distal end of each of the toe arms is pivotally affixed to the lower toe plate such that each toe arm is substantially parallel to an adjacent toe arm, therefore forming a parallelogram with the upper toe plate and the lower toe plate. The toe mechanism provides parallel synchronization between the upper toe plate and a lower toe plate. There is at least one energy storage mechanism (e.g. spring, magnets, rubber band, piston, bladder, etc.) interfaced to store energy as pressure is exerted between the upper toe plate and the lower toe plate, and the energy storage mechanism releases stored energy when the pressure abates.

In another embodiment, an energy-return shoe system is described including a shoe portion having a bottom surface. An upper toe plate is affixed to the bottom surface of the shoe portion in a toe area of the shoe portion. A lower toe plate is affixed to a top surface of the toe area of a lower sole and two toe arms connect the upper toe plate to the lower toe plate. A first end of each toe arm is pivotally affixed to the upper toe plate and a distal end of each of the toe arms is pivotally affixed to the lower toe plate. The toe arms are substantially parallel to each other. The lower sole is made of a flexible rubber material and there is at least one spring mechanism that urges the shoe portion away from the lower sole.

In another embodiment, a method of using an energy return shoe is described, including providing two energy return shoe mechanisms as described above, wearing a first energy return shoe mechanism on a left foot and wearing a second energy return shoe mechanism on a right foot. The steps include stepping down on the first energy return shoe mechanism, thereby compressing the toe mechanism of the first energy return shoe mechanism and storing energy in the at least one energy storage mechanism of the first energy return shoe mechanism the lifting up on the first energy return shoe mechanism, whereas energy from the at least one energy storage mechanism of the first energy return shoe mechanism is released helping to propel the left foot. Next, stepping down on the second energy return shoe mechanism, thereby compressing the toe mechanism of the second energy return shoe mechanism and storing energy in the at least one energy storage mechanism of the second energy return shoe mechanism then lifting up on the second energy return shoe mechanism, whereas energy from the at least one energy storage mechanism of the second energy return shoe mechanism is released helping to propel the left foot. These steps are repeated to achieve a faster rate of movement than would be achieved with typical standard shoes.

BRIEF DESCRIPTION OF THE DRAWINGS

The invention can be best understood by those having ordinary skill in the art by reference to the following detailed description when considered in conjunction with the accompanying drawings in which:

FIG. 1C illustrates a side plan view of the system with a travel stop shown in a compressed state.

DETAILED DESCRIPTION OF THE INVENTION

Figure 1A:
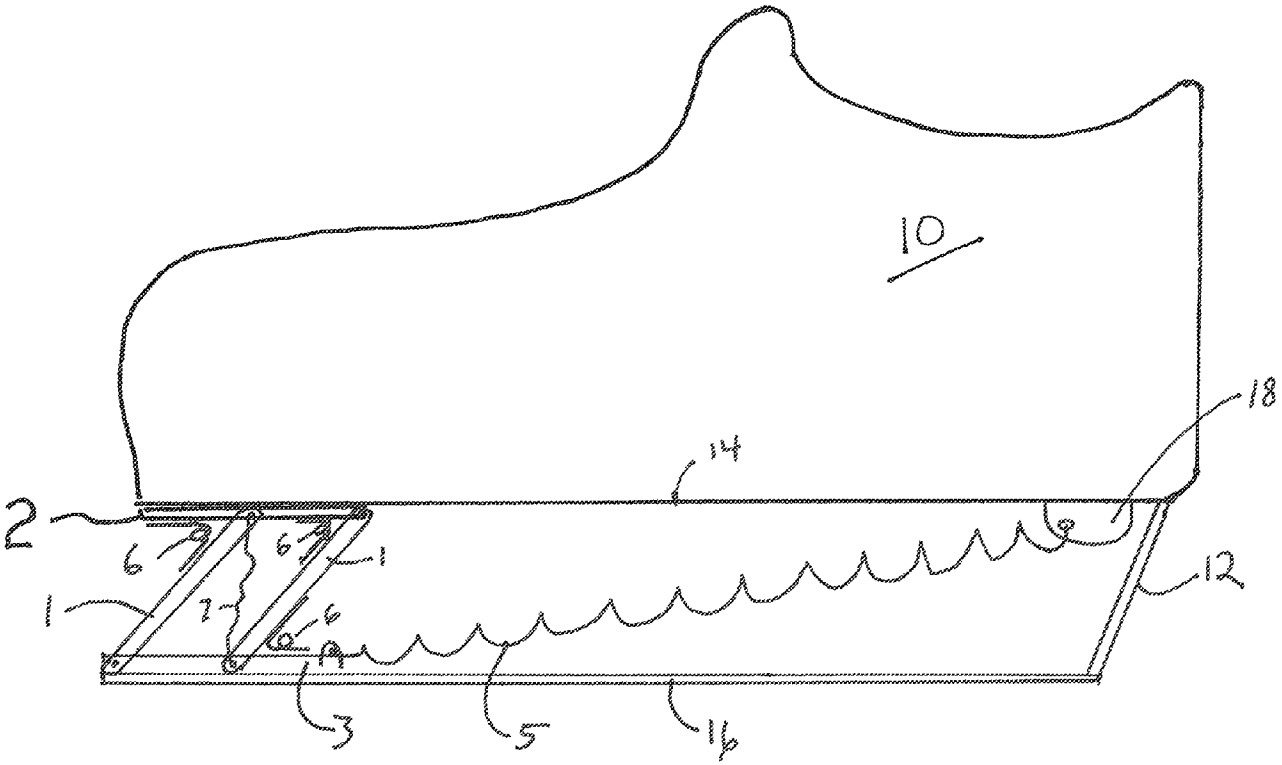
FIG. 1A illustrates a side plan view of the system shown in a compressed state.

Reference will now be made in detail to the presently preferred embodiments of the invention, examples of which are illustrated in the accompanying drawings. Throughout the following detailed description, the same reference numerals refer to the same elements in all figures. For the purpose of this specification, the term "shoe" is used generically, meaning any type of footwear including, but not limited to, shoes, boots, snowshoes, ski boots, ice skates and roller skates.

Throughout this description, the term "parallel synchronization" refers to keeping two surfaces or plates in the same longitudinal relationship to each other while allowing the two surfaces or plates to move vertically with respect to each other, each set of points moving together or apart the same amount of distance. In parallel synchronization, one plate is allowed to move forward or backward with respect to the other plate. For example, the top plate is capable of moving back with respect to the bottom plate, but the rate of closure between top plate and second plate is similar across the length of the plate.

Throughout this description, spring and/or spring device refers to a device that accepts, stores and returns energy as would an ordinary spring. Many types of springs are well known. Different types of springs are known to have different force curves and, therefore, in any example where one type of spring is shown, it is anticipated that a different type of spring device be used or a combination of spring devices be used to achieve a desired force curve and shoe operation. In addition, other energy storage/return devices are considered equivalent to springs for the purpose of this disclosure, including, but not limited to, magnets with matching pole alignments (e.g. North to North), gas pistons, air bladders, balloons, etc.

Referring to FIGS. 1-4, the simplified energy-return shoe system is shown. To achieve stability, the simplified energy-return shoe system includes a toe suspension mechanism 8 shown in detail in FIG. 2. The toe suspension mechanism 8 includes an upper toe plate 2 that is affixed to the toe area of the bottom 14 of the shoe portion 10. The toe suspension mechanism also includes a lower toe plate 3 that is affixed to a toe area of a lower sole 16. The upper toe plate 2 and lower toe plate 3 are held in parallel synchronization to each other by toe arms 1. Although two toe arms 1 are shown, more toe arms 1 are anticipated, any number of at least two toe arms 1 are envisioned. By forming a parallelogram between the upper toe plate 2, neighboring toe arms 1, and the lower toe plate 3, the upper toe plate 2 is held in parallel synchronization with the lower toe plate 3. By this, as the upper toe plate 2 converges or diverges with respect to the lower toe plate 3, the angular relationship between the upper toe plate 2 and the lower toe plate 3 remains substantially the same. Therefore, if in a relaxed state, the angular relationship between the upper toe plate 2 and the lower toe plate 3 is zero degrees (e.g. the upper toe plate 2 is parallel to the lower toe plate 3, as the upper toe plate 2 converges towards the lower toe plate 3, the angular relationship remains substantially the same and, therefore, in this example, the upper toe plate 2 remains substantially parallel to the lower toe plate 3. The parallel synchronization between the upper toe plate 2 and the lower toe plate 3 provides a stable, controlled compression between the lower surface 14 of the shoe portion 10 and the lower sole 16, thereby providing more stability to a person wearing such a shoe system and eliminating the feeling of "walking on ice" that is commonly felt with energy return shoe systems that, for example, include only springs. In such prior-art shoe systems, because there was no parallel synchronization, the shoe portion moves almost randomly with respect to a lower sole portion, thereby making the wearer feel as if they were walking on ice and leading to an increased potential for falling.

In the toe mechanism 8, a first end of each arm 1 is pivotally attached to the upper toe plate 2 by pivot pins 31 and a distal end of each arm 1 is pivotally attached to the lower toe plate 3 by pivot pins 31. This allows the upper toe plate 2 to move horizontally (e.g. towards the heel area) during compression and expansion between the upper sole 14 and the lower sole 16, although it is also possible to reverse the compression and expansion directions. Due to the parallelogram formed by the upper toe plate 2, the arms 1 and the lower toe plate 3, the upper toe plate 2 maintains parallel synchronization with the lower toe plate 3 as the upper toe plate 2 converges or diverges with the lower toe plate 3. In this, a plane of the upper toe plate 2 maintains a constant angle with respect to a plane of the lower toe plate 3. For example, if the plane of the upper toe plate 2 is parallel to the plane of the lower toe plate 3 (angle is zero degrees), then the plane of the upper toe plate 2 remains parallel to the plane of the lower toe plate 3 throughout compression and expansion.

As shown, one or more resilient devices 5/6 urge the upper toe plate 2 away from the lower toe plate 3. As shown, an expansion spring 5 pulls between a flange 4 on the lower toe plate 3 and an upper flange 18 that is affixed or part of the lower shoe portion. As the toe area is compressed, the expansion spring 5 stretches, storing energy in the spring 5 until the wearer starts to shift weight, at which time the expansion spring 5 returns some of the stored energy to help the wearer push off. In some embodiments, multiple springs 5/6 are used to implement greater return force and/or various force curves. In the examples shown in FIGS. 1*a*-1*c*, a plurality of torsion springs 6 are employed in the closure angles between the toe arms 1 and the upper toe plate 2 and between the toe arms 1 and the lower toe plate 3. In the example shown, three torsion springs 6 are employed.

In some embodiments, the spring 5 is a resilient member such as a rubber band. In some embodiments, reverse polarized magnets are used to store the compression energy and urge the upper toe plate 2 away from the lower toe plate 3 during expansion. Any number and/or type of spring are anticipated.

Figure 1B:
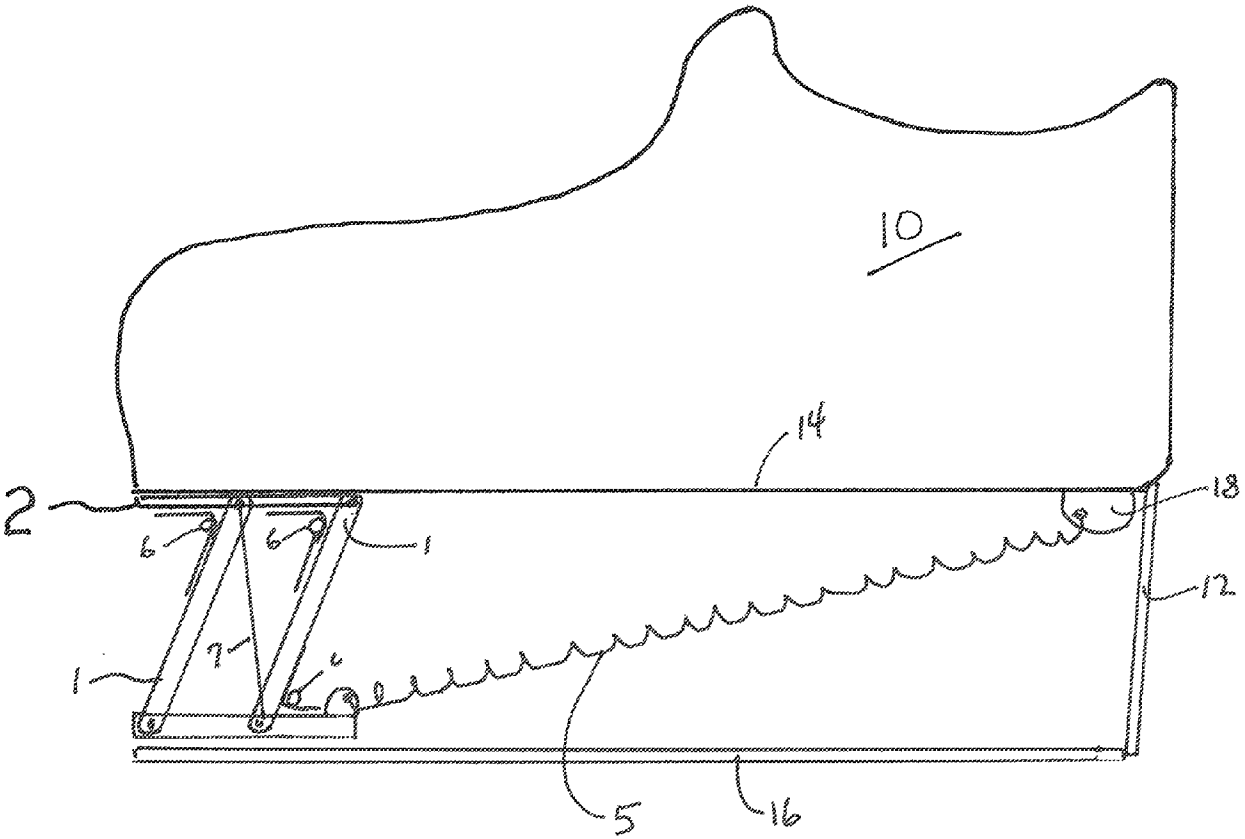
FIG. 1B illustrates a side plan view of the system shown in a relaxed state.
Figure 16:
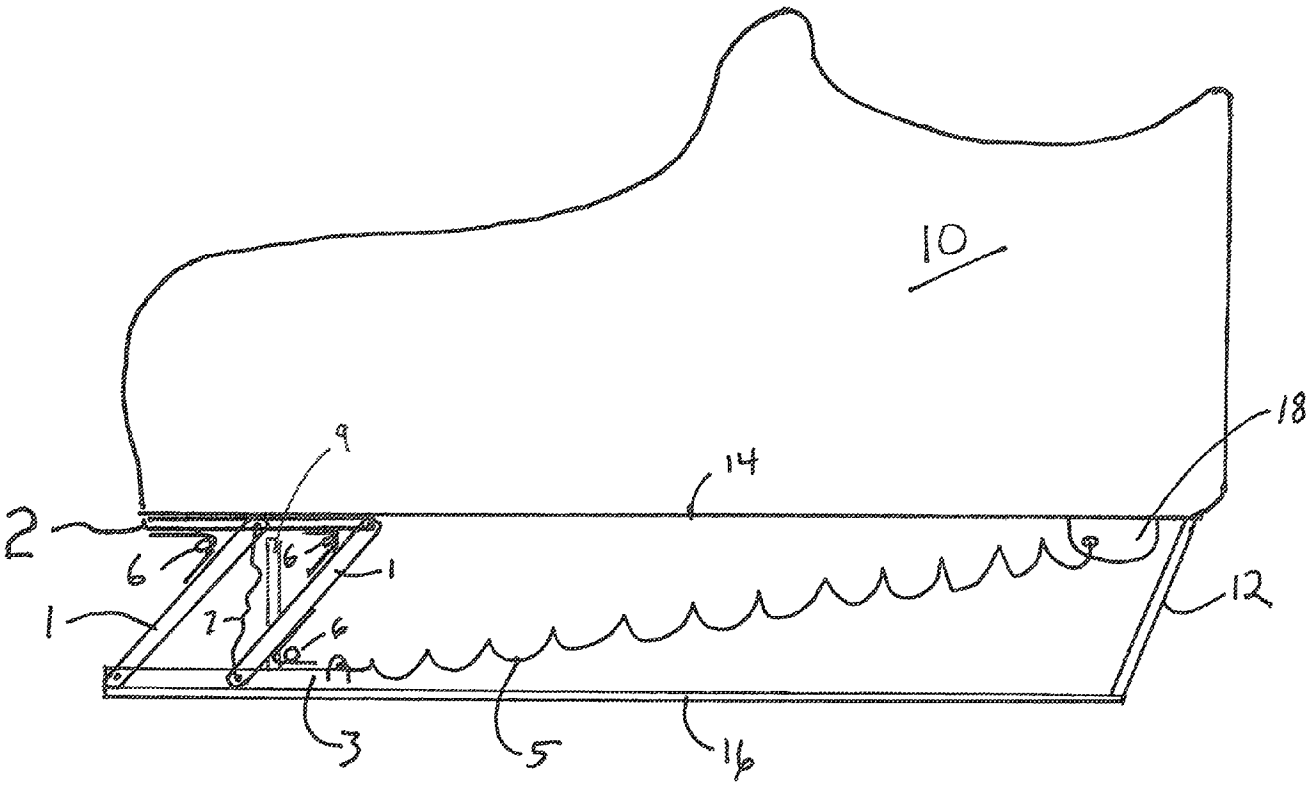
Figure 2:
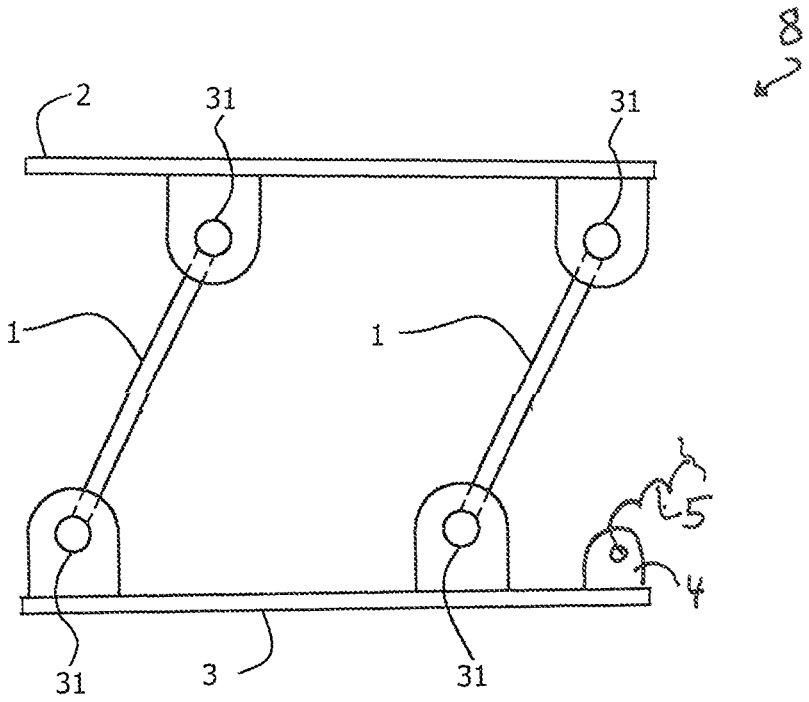
FIG. 2 illustrates a detail side plan view of the toe mechanism of the shoe system.

It is preferred to prevent the arms 1 from opening so far as to be at right angles with respect to the toe plats 2/3. If such was allowed to occur, compression would be prevented until the acute angle was restored. To prevent the arms 1 from opening to a 90 degree or greater angle with respect to the toe plates 2/3, a device is provided to prevent such. Although many different devices are anticipated such as stops, pins, etc., for simplicity, one such device is shown; a cable, wire, string 7 limits divergence between the toe plates 2/3. As shown in FIG. 1A, the cable 7 is loose being that the toe plates 2/3 are being forced to converge by the wearer of the shoe portion 10. As the wearer lifts on the shoe portion 10, the toe plates 2/3 diverge until the cable 7 is fully extended as shown in FIG. 1B, at which time the toe plates 2/3 cannot diverge any further by the limitation of the length of the cable 7. Again, other mechanisms are anticipated to prevent the arms 1 from opening so far as to be at right angles with respect to the toe plates 2/3, including, but not limited to, surface of the arms 1 that abut against the upper/lower toe plates 2/3, pins in tracks such that the track ends at a point before the toe arms 1 are at 90 degree angles with respect to the toe plates 2/3, etc.

It is also preferred to limit closure of the toe mechanism 8 to limit damage due to excessive force. To prevent the toe mechanism 8 from closing too far, a preferably resilient stop 9 is placed between the toe plates 2/3 or between one of the toe plates 2/3 and one or more of the arms 1. As shown in FIG. 1C, the resilient stop 9 prevents the toe plates 2/3 from converging any further than shown. Although many different stops are anticipated, one exemplary resilient stop 9 is one or more hard-rubber piece(s) 9 that compresses slightly under force, thereby reducing shock and noise when the wearer steps down.

Figure 3:
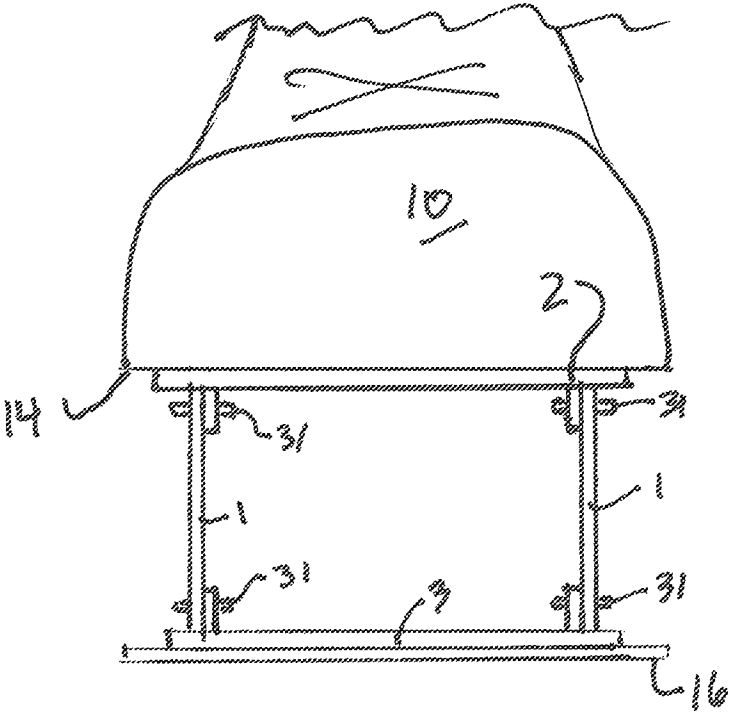
FIG. 3 illustrates a front plan view of the toe mechanism of the shoe system.

It is anticipated that the sole 16 and rear wall 12 are made of a flexible material (e.g. rubber). When the toe mechanism 8 is compressed as shown in FIG. 1A, the lower toe plate 3 is in parallel synchronization with the upper toe plate 2, but the lower toe plate 3 moves or is positioned forward of the upper toe plate 2. Since the lower toe plate 3 is affixed to the sole 16, the sole 16 also slides forward and the rear wall 12 bends to accommodate this as shown in FIG. 1A. As compression abates, as shown in FIG. 1B, the lower toe plate 3 is still in parallel synchronization with the upper toe plate 2. The lower toe plate 3 moves back with respect to the upper toe plate 2 during expansion. Being that the lower toe plate 3 is affixed to the sole 16, the lower 16 also slides back and the rear wall 12 bends/restores to accommodate this as shown in FIG. 1B Referring to FIGS. 3 and 4, front views of the energy return shoe system are shown. FIG. 3 shows a configuration in which the toe arms 1 are at right angles with respect to the lower toe plate 3 and interface to the lower toe plate 3 with a sideways pivot 31. It is also anticipated that, in some embodiments, the toe arms are at a slight angle with respect to the lower toe plate 3, providing the wearer better/different control when cornering.

Figure 4:
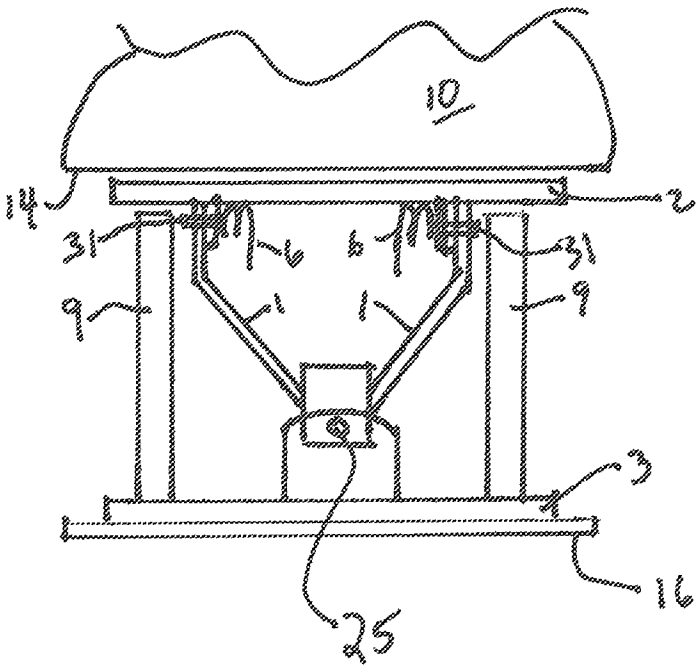
FIG. 4 illustrates a front plan view of the of the toe mechanism of the shoe system having a side pivot.

FIG. 4 shows a configuration in which the toe arms 1 are vertical with respect to the upper toe plate 2 then bend to converge at a pivot 25, the pivot interfaces to the lower toe plate 3. In some embodiments, the rotation of the pivot 25 is controlled to a certain angle by stops, etc. The pivot 25 provides the wearer better/different control when cornering, adjusting to the wearer's center of gravity as they make a turn.

Any known pivot mechanism 25 is anticipated. In the example shown in FIG. 4, the resilient stops 9 are situated between the upper toe plate 2 and the lower toe plate 3 in areas outside of the toe mechanism 1/2/3.

Equivalent elements can be substituted for the ones set forth above such that they perform in substantially the same manner in substantially the same way for achieving substantially the same result.

It is believed that the system and method of the present invention and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely exemplary and explanatory embodiment thereof. It is the intention of the following claims to encompass and include such changes.

What is claimed is:

1. An energy-return shoe system comprising:

a shoe portion having a toe end for accepting toes of a wearer and a heel end for accepting a heel of the wearer, the shoe portion having a bottom surface, the bottom surface having a toe area at the toe end;

a toe mechanism for providing parallel synchronization, the toe mechanism comprising:

an upper toe plate affixed to the bottom surface of the toe area of the shoe portion, the upper toe plate within the toe area of the bottom surface extending less than half of a length of the bottom surface;

a lower sole having a toe area at the toe end;

a lower toe plate affixed to a top surface of the lower sole in the toe area of the lower sole;

a plurality of toe arms, a first end of each toe arm pivotally affixed to the upper toe plate and a distal end of each of the toe arms pivotally affixed to the lower toe plate, each toe arm substantially parallel to an adjacent toe arm; and at least one energy storage mechanism interfaced to store energy as pressure is exerted between the upper toe plate and the lower toe plate, and the energy storage mechanism releases stored energy when the pressure abates.

2. The energy-return shoe system of claim 1, wherein the at least one energy storage mechanism comprises an expansion spring interfaced between the lower toe plate and a flange at the heel area of the shoe portion.

3. The energy-return shoe system of claim 2, wherein the at least one energy storage mechanism further comprises a plurality of torsion springs, each of the torsion springs interfaced between the toe arms and either of the upper toe plate, lower toe plate, or both.

4. The energy-return shoe system of claim 1, wherein the lower sole is made of flexible rubber.

5. The energy-return shoe system of claim 4, further comprising a rear wall made of flexible rubber, the rear wall interfaced between a heel area edge of the sole and a heel area of the shoe portion.

6. The energy-return shoe system of claim 1, further comprising a mechanism that limits rotation of the toe arms to an angle that is less than vertical with respect to the upper toe plate.

7. The energy-return shoe system of claim 6, wherein the mechanism that limits rotation of the toe arms is a wire, a first end of the wire affixed to the upper toe plate and a second end of the wire affixed to the lower toe plate.

8. The energy-return shoe system of claim 1, further comprising a mechanism that limits compression between the upper toe plate and the lower toe plate.

9. A method of running comprising:

providing two energy return shoe mechanisms as described in claim 1;

wearing a first energy return shoe mechanism of the two energy return shoe mechanisms on a left foot;

wearing a second energy return shoe mechanism of the two energy return shoe mechanisms on a right foot;

stepping down on the first energy return shoe mechanism, thereby compressing the toe mechanism of the first energy return shoe mechanism and storing energy in the at least one energy storage mechanism of the first energy return shoe mechanism; and lifting up on the first energy return shoe mechanism, whereas energy from the at least one energy storage mechanism of the first energy return shoe mechanism is released helping to propel the left foot.

10. The method of claim 9, further comprising:

stepping down on the second energy return shoe mechanism, thereby compressing the toe mechanism of the second energy return shoe mechanism and storing energy in the at least one energy storage mechanism of the second energy return shoe mechanism; and lifting up on the second energy return shoe mechanism, whereas energy from the at least one energy storage mechanism of the second energy return shoe mechanism is released helping to propel the left foot.

11. The method of claim 10, wherein each of the at least one energy storage mechanisms of the first energy return shoe mechanism and of the second energy return shoe mechanism are extension springs.

12. An energy-return shoe system comprising:

a shoe portion having a toe end for accepting toes of a wearer and a heel end for accepting a heel of the wearer, the shoe portion having a bottom surface;

an upper toe plate affixed to the bottom surface at the toe end of the shoe portion, the upper toe plate within the toe end of the bottom surface extending less than half of a length of the bottom surface;

a lower sole having a toe area at the toe end, the lower sole made of a flexible rubber material;

a lower toe plate affixed to a top surface of the lower sole in the toe area of the lower sole;

means for maintaining parallel synchronization between the upper toe plate and the lower toe plate; and means for urging the shoe portion away from the lower sole.

13. The energy-return shoe system of claim 12, wherein the means for urging comprises an expansion spring interfaced between the lower toe plate and the heel area of the shoe portion.

14. The energy-return shoe system of claim 13, wherein the means for urging further comprises a plurality of torsion springs.

15. The energy-return shoe system of claim 12, further comprising a rear wall made of flexible rubber, the rear wall interfaced between a heel area edge of the sole and a heel area of the shoe portion.

16. The energy-return shoe system of claim 12, further comprising means for limiting opening of the means for maintaining parallel synchronization.

17. The energy-return shoe system of claim 16, wherein the means for limiting closure is a wire, a first end of the wire interfaced to the upper toe plate and a second end of the wire interfaced to the lower toe plate.

18. The energy-return shoe system of claim 12, further comprising a mechanism that limits compression between the upper toe plate and the lower toe plate.

19. The method of claim 18, wherein each of the energy return shoe mechanisms includes a limiting device that limits the extent in which the toe mechanisms compress during the step of stepping down.

20. The method of claim 18, wherein each of the energy return shoe mechanisms includes a mechanism that limits expansion of the toe mechanism such that an angle between the toe arms and the upper toe plate is always less than 90 degrees.

* * * * *